US009349356B2

(12) United States Patent
Yoshino

(10) Patent No.: US 9,349,356 B2
(45) Date of Patent: May 24, 2016

(54) DRUM HEADS AND DRUMS

(71) Applicant: Roland Corporation, Hamamatsu (JP)

(72) Inventor: Kiyoshi Yoshino, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 229 days.

(21) Appl. No.: 13/853,490

(22) Filed: Mar. 29, 2013

(65) Prior Publication Data

US 2014/0060284 A1 Mar. 6, 2014

(30) Foreign Application Priority Data

Sep. 4, 2012 (JP) ..... 2012-194421

(51) Int. Cl.
*G10D 13/02* (2006.01)

(52) U.S. Cl.
CPC ..... *G10D 13/027* (2013.01); *G10D 13/024* (2013.01); *Y10T 29/49574* (2015.01)

(58) Field of Classification Search
USPC ..... 84/411 R
See application file for complete search history.

(56) References Cited

U.S. PATENT DOCUMENTS

| | | | | | |
|---|---|---|---|---|---|
| 4,362,081 | A * | 12/1982 | Hartry | G10D 13/027 | 84/414 |
| 4,798,121 | A * | 1/1989 | Donohoe | G10D 13/027 | 84/414 |
| 5,159,139 | A * | 10/1992 | Beals | G10D 13/027 | 84/414 |
| 5,892,168 | A * | 4/1999 | Donohoe | G10D 13/022 | 84/411 M |
| 6,271,458 | B1 | 8/2001 | Yoshino et al. | | |
| 6,297,177 | B1 * | 10/2001 | Belli | G10D 13/027 | 442/242 |
| 6,365,812 | B1 * | 4/2002 | McGill | G10D 13/027 | 84/413 |
| 6,756,535 | B1 | 6/2004 | Yoshino et al. | | |
| 6,921,857 | B2 | 7/2005 | Yoshino et al. | | |
| 6,949,701 | B2 * | 9/2005 | Okumura | G10D 13/027 | 84/411 R |
| 7,385,135 | B2 | 6/2008 | Yoshino et al. | | |
| 7,642,439 | B2 * | 1/2010 | Fujii | 84/411 M | |
| 8,148,619 | B1 * | 4/2012 | May | G10D 13/022 | 84/411 M |
| 2003/0136244 | A1 | 7/2003 | Okumura | | |
| 2010/0175535 | A1 * | 7/2010 | Lento | G10D 13/021 | 84/414 |
| 2013/0042744 | A1 * | 2/2013 | Hsien | G10D 13/027 | 84/414 |

FOREIGN PATENT DOCUMENTS

| | | | |
|---|---|---|---|
| CN | 101807392 | B | 8/2011 |
| GB | 2 113 888 | | 8/1983 |
| JP | 55-032850 | U | 3/1980 |
| JP | 61-061593 | U | 4/1986 |
| JP | 64-054095 | U | 4/1989 |
| JP | 64-054096 | U | 4/1989 |
| JP | 2559594 | Y2 | 9/1997 |

OTHER PUBLICATIONS

Extended European Search Report dated Nov. 8, 2013, from related European patent application No. 13166765.1.

* cited by examiner

*Primary Examiner* — Christopher Uhlir
(74) *Attorney, Agent, or Firm* — Foley & Lardner LLP

(57) ABSTRACT

A drum head having a striking feeling similar to an acoustic drum includes an inner head layer and a pair of outer head layers. The outside diameter of the inner head layer is smaller than the outside diameter of a flat part of the outer head layers and the inside diameter of the edge of the shell. The inner head layer is inside the connection part between the flat part and a cylindrical part of the outer head layers and the shell edge part. When tension is applied to the outer head layers, tension is prevented from being applied to the inner head layer.

21 Claims, 3 Drawing Sheets

DRUM HEADS AND DRUMS

CROSS-REFERENCE TO RELATED PATENT APPLICATIONS

Japan Priority Application No. 2012-194421, filed on Sep. 4, 2012, including the specification, drawings, claims and abstract, is incorporated herein by reference in its entirety.

FIELD OF THE INVENTION

Embodiments of the present invention relate to drum heads, drums that include such drum heads and methods of making and using such drum heads and drums, and, in particular embodiments, to drum heads, drums and methods for providing a striking feeling similar to that created when striking the head of a typical acoustic drum, while reducing the acoustic striking sound relative to that of a typical acoustic drum.

BACKGROUND

Some drum heads have been configured to produce, when struck, reduced acoustic striking sounds relative to typical acoustic drum heads made of film material. Such drum heads may be used, for example, to form a striking surface of an electronic drum or striking surface of a practice drum that imitates the feel of an acoustic drum.

For example, Japanese laid-open patent application HEI 10-020854 describes a drum head formed from a net-like material composed of plural nets.

However, that type of a drum head can more readily stretch when struck, compared to the head made of a typical film used for an acoustic drum, resulting in a strike response that can feel weak to the performer.

Also, Japanese laid-open patent application 2009-229514 describes a drum head with a striking part, at least a portion of which is made of a rubber foam body having independent bubbles (cavities that do not communicate with the open air).

However, with that type of a drum head, a drum stick or the like can tend to rebound from the elastic force of the drum head after the drum head is struck. As a result, the striking feeling when striking that type of a drum head can be somewhat different compared to an acoustic drum that drives back a drum stick or the like by the tension of the head.

Therefore, certain previous drum heads that were designed to reduce acoustic striking sounds have a configuration that provides a striking feeling different from that of an acoustic drum.

SUMMARY OF THE DISCLOSURE

In contrast, embodiments of the present invention relate to drum heads that are capable of producing reduced acoustic sound, while providing a striking feeling similar to the feeling of striking the head of an acoustic drum. Further embodiments relate to drums that include such drum heads and methods of making and using such drum heads and drums.

A drum head according to an embodiment of the present invention has an inner head layer provided between a pair of outer head layers. Therefore, by increasing the density of the striking surface formed with the pair of outer head layers and the inner head layer, the weight per unit area of the striking surface can be increased. As a result, one or both of the outer head layers can be composed of breathable material, and the feel of its striking surface can be approximated to that of a head made of a film used for an acoustic drum.

Also, the inner head layer is located inside the inner circumferential surface of a frame part, and the outer shape of the inner head layer, as viewed in an axial direction of the frame part, is formed smaller than the inner circumference of the shell that stretches the outer head layer. Therefore, when tension is applied to the pair of outer head layers, the tension can be prevented from being applied to the inner head layer. As a result, rebounding of the pair of outer head layers and the inner head layer, when struck, can be suppressed, compared to a case where tension is applied to the inner head layer as well as both of the outer head layers. Therefore, a stronger response to striking the drum head can be produced and felt by the performer.

In this manner, by including the inner head layer between the pair of outer head layers, and stretching the drum head onto the shell without applying tension to the inner head layer, striking sound upon striking the drum head can be reduced, and striking feeling similar to the feeling generated upon striking the head of an acoustic drum can be obtained.

In a further example of a drum head according to the above-described embodiment, the inner head layer is disposed inside a connection part between a flat part and a cylindrical part of the pair of outer head layers. Therefore, when tension is applied to the pair of outer head layers, the tension can be prevented from being applied to the inner head layer. As a result, rebounding of the pair of outer head layers and the inner head layer upon striking of the drum head can be better suppressed, compared to the case where tension is applied to the inner head layer as well as the pair of outer head layers. Therefore, a stronger response when striking the flat part can be produced and felt.

In a further example of a drum head according to the above-described embodiments, the inner head layer is composed of a breathable material. As a result, the inner layer may pass air that passes through the outer head layers when the flat part is struck. Therefore, the acoustic striking sound generated when the drum head is stuck can be further reduced.

In a further example of a drum head according to the above-described embodiments, the outside diameter of the inner head layer is arranged, as viewed in an axial direction of the frame part, within an area enclosed by a virtual circle concentric with the frame part, and is a half of the inside diameter of the frame part. As a result, a portion of the drum head where the inner head layer is arranged can be more readily struck.

In a further example of a drum head according to the above-described embodiments, the inner head layer is bonded or otherwise attached to at least one of the pair of the outer head layers. Accordingly, relative displacement, in the radial direction of the frame part, of the inner head layer with respect to the pair of outer head layers can be restricted. Therefore, when the outer head layers are stretched over the shell, it is easier to maintain the inner head layer inside the inner circumference of the shell. In that regard, the process of stretching the drum head over the shell can be more easily accomplished.

The breathability of the outer head layers can decrease in the areas where the inner head layer is bonded to one or both of outer head layers. In this respect, the ratio of the area where the inner head layer is bonded to the outer head layer, to the area of the entire inner head layer may be selected to be 10% or less, for reliable breathability of the outer head layers. Accordingly, the acoustic striking sound generated upon striking the drum head can be reduced.

In a further example of a drum head according to the above-described embodiments, the two outer head layers are bonded together in an area outside the outer periphery of the inner head layer and inside the inner circumference of the shell on which the outer head layers are stretched, as viewed in an axial direction of the frame part. As a result, relative displacements of the inner head layer with respect to the pair of outer head layers can be restricted in the radial direction of the frame part. Therefore, when the outer head layers are stretched over the shell, it is easier to maintain the inner head layer inside the inner circumference of the shell. In that regard, the process of stretching the drum head over the shell can be more easily accomplished.

In a further example of a drum head according to the above-described embodiments, the pair of outer head layers and the inner head layer are composed of the same material. As a result, when the drum head is struck, the inner head layer can be deformed according to deformation caused by extension of the pair of outer head layers. Therefore, generation of acoustic sound from the outer head layers colliding against the inner head layer can be suppressed. Accordingly, the acoustic striking sound can be further reduced.

BRIEF DESCRIPTION OF THE DRAWINGS

FIG. 1(*b*) is an enlarged cross-sectional view of a portion Ib of the drum shown in FIG. 1(*a*).

FIG. 3(*b*) is a top plan view of a drum head in accordance with a third embodiment of the present invention.

FIG. 3(*c*) is a top plan view of a drum head in accordance with a fourth embodiment of the present invention.

FIG. 3(*d*) is a top plan view of a drum head in accordance with a fifth embodiment of the present invention.

DETAILED DESCRIPTION

Figure 1:
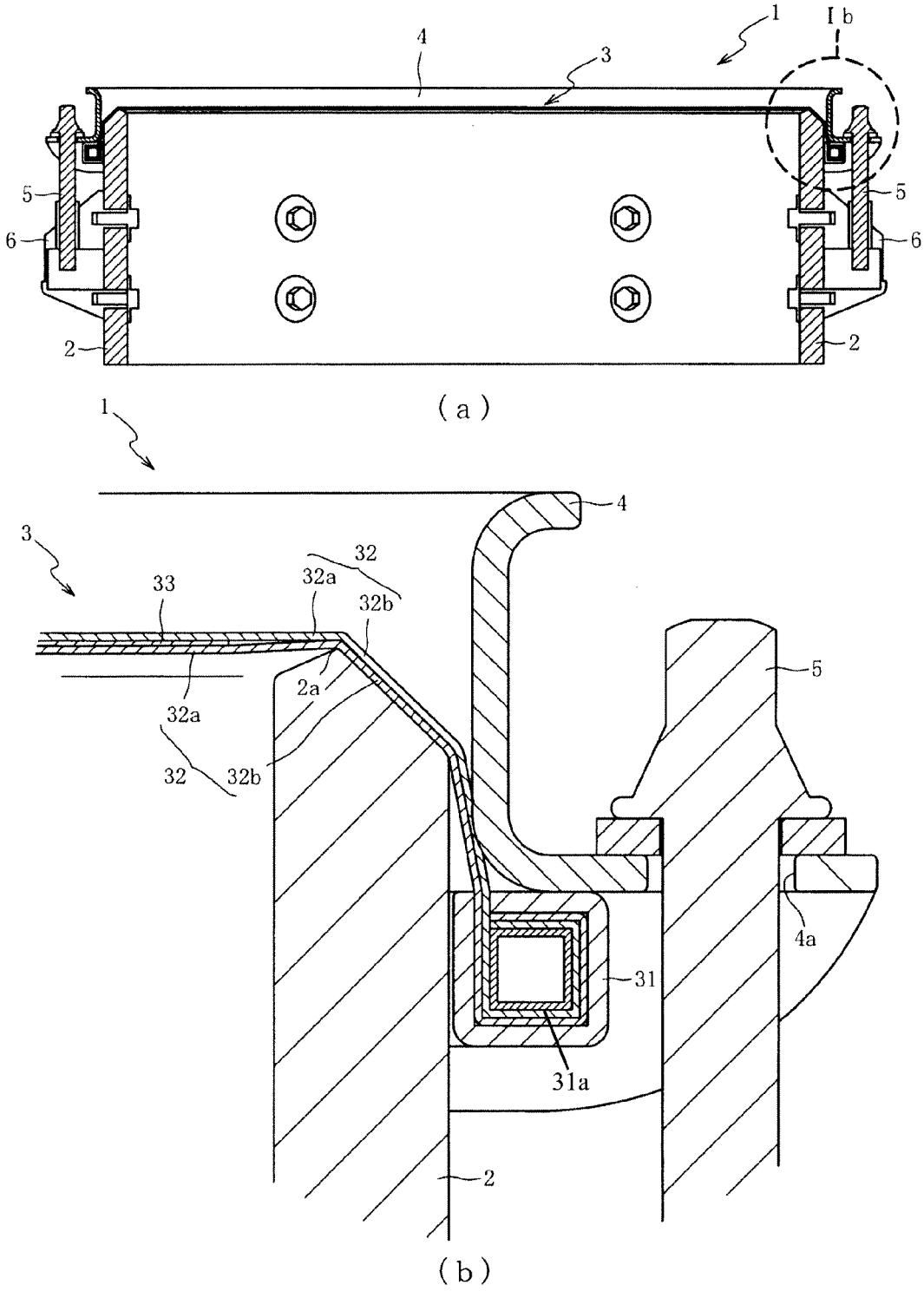
FIG. 1(*a*) is a cross-sectional view of a drum with a drum head in accordance with an embodiment of the invention.

Example embodiments of the invention are described with reference to the accompanying drawings. FIG. 1 is a cross-sectional view of a drum 1 that includes a drum head 3 according to an embodiment of the invention stretched over the body of the drum 1. FIG. 1(*b*) is an enlarged cross-sectional view of the portion Ib of the drum 1 in FIG. 1(*a*). FIG. 1(*a*) shows a cross section taken along a straight line that passes through a pair of tension bolts 5 arranged opposite each other across the axis of a frame part 31.

In the embodiments shown in FIG. 1(*a*) and FIG. 1(*b*), the drum 1 is a drum for practice that is configured to imitate an acoustic drum. The drum 1 has a shell 2, a drum head 3, a hoop 4, tension bolts 5, and lugs 6. The shell 2 composes a body of the drum 1. The drum head 3 is stretched over the shell 2. The hoop 4 is retained to the drum head 3. The tension bolts 5 are retained to the hoop 4. Each lug 6 is affixed to the outer circumference of the shell 2 and the tension bolts 5 are threaded into the lugs 6.

In the illustrated embodiment, the shell 2 is a cylindrical member having openings on both sides in the axial direction. The drum head 3 is stretched over one side (the top side in FIG. 1(*a*)) in the axial direction.

The drum head 3 forms a striking surface to be struck by the performer. When the drum head 3 is stretched over the shell 2, the drum head 3 contacts a part 2*a* on one side of the shell in the axial direction.

Figure 2:
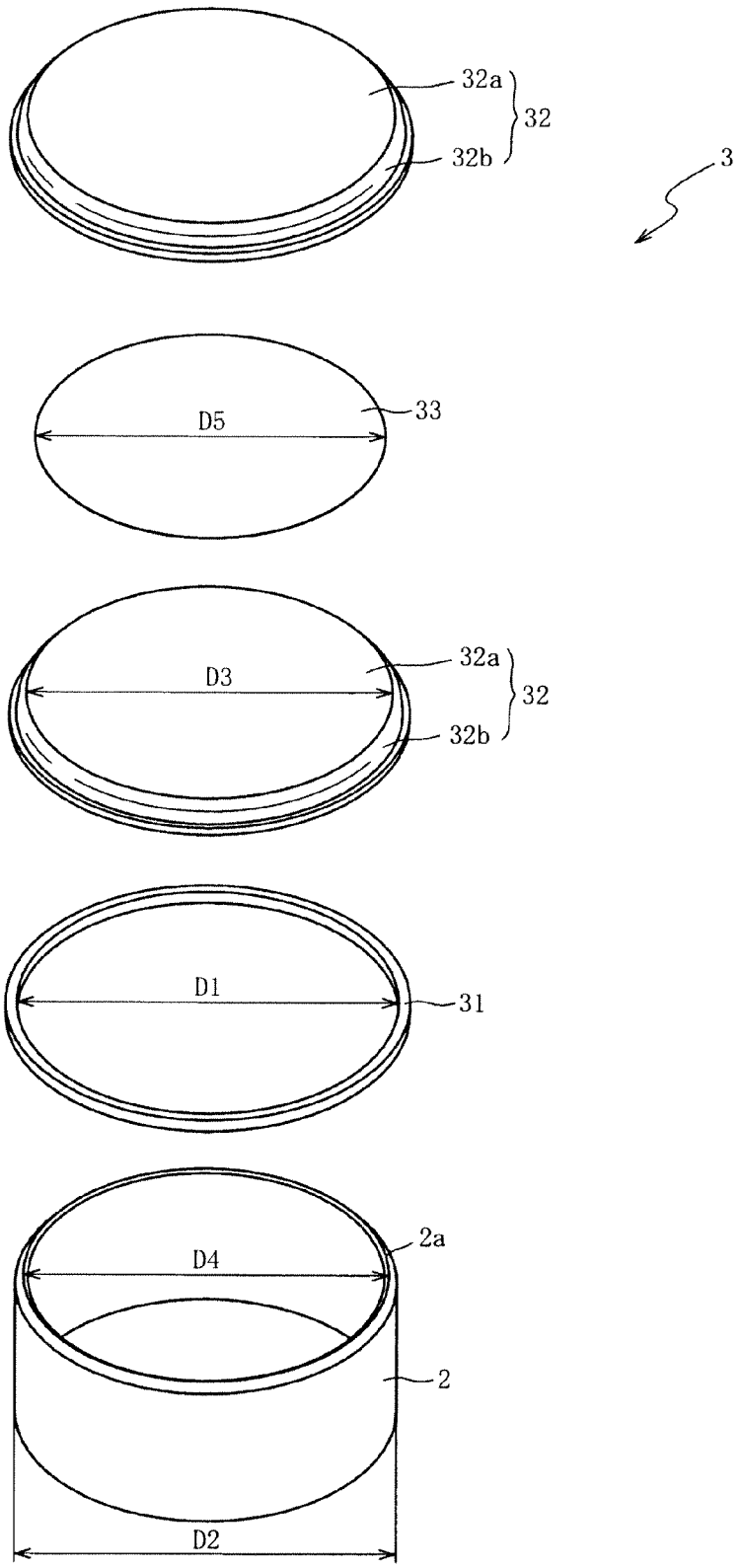
FIG. 2 is a perspective view of a shell and an exploded perspective view of a drum head according to the embodiment of FIG. 1(*a*).

FIG. 2 is a perspective view of the shell 2 and an exploded perspective view of the drum head 3. In FIG. 2, an illustration of the lug 6 affixed to the outer circumference of the shell 2 is omitted.

The drum head 3 includes a ring-shaped frame part 31, a pair of outer head layers 32 and an inner head layer 33. The outer peripheral edges of the outer head layers 32 are affixed to the frame 31. The inner head layer 33 is arranged between the pair of outer head layers 32. In an example embodiment, the outer peripheral edges of the outer head layers 32 are wound around a hollow ring-shaped member 31*a* that has a square cross section. Then, the hollow ring-shaped member 31*a* (with the outer peripheral edges of the outer head layer 32 wound around it) is inserted into an open, upper side of the frame part 31, and the frame part 31 is thereafter closed to retain the hollow ring-shaped member 31*a* and the outer head layers to the frame part 31.

The frame part 31 is retained on the shell 2 by the hoop 4. In particular embodiments, the frame part 31 is composed of a metal material having predetermined rigidity. In other embodiments, the frame part 31 is composed of other suitable materials, such as, but not limited to, a resin material, having a suitable rigidity. The inside diameter D1 of the frame part 31 is larger than the outside diameter D2 of the shell 2. Accordingly, the frame part 31 fits over the outer circumference of the shell 2 so that one side of the drum head 3 contacts the part 2*a* of the shell 2 when the drum head 3 is stretched over the shell 2.

The pair of outer head layers 32 is stretched over one side of the shell 2 and forms a striking surface to be struck by a performer. In particular embodiments, the outer head layers 32 are each composed of a net-like plain woven material having breathability (having openings sufficient to allow air to pass through). Because the outer head layers 32 are composed of a net-like material, the striking sound generated when the head is struck can be reduced. The outer head layers 32 in the pair are composed of the same material. According to embodiments of the present invention, the outer head layers 32 are composed of a plain woven net-like material. In other embodiments, the outer head layer 32 may be composed of a net-like twill woven material. However, with the outer head layers 32 composed of a plain woven material, the breathability of the outer head layers 32 can be increased, compared to a case where the outer head layers 32 are composed of a net-like twill woven material. However, by composing the outer head layers 32 with a net-like twill woven material, the density of the outer head layers 32 can be increased, thus increasing its weight per unit area, compared to the case where the outer head layers 32 are composed of a net-like plain woven material. Therefore, the striking surface can be approximated to the feel of a head made of a film used for an acoustic drum.

The pair of outer head layers 32 has a flat part 32*a*, and a cylindrical part 32*b*. The flat part 32*a* forms a striking surface. The cylindrical part 32*b* is formed in a cylindrical shape and has one end connected to the outer periphery of the flat part 32*a*, and a second end affixed to the frame part 31.

The flat part 32*a* defines a planar surface part that is formed in a generally circular shape as viewed in a top-down view (viewed in the axial direction of the shell 2). The outside diameter D3 of the flat part 32*a* is generally equal to the inside diameter D4 of the end part 2*a* on one side of the shell 2 in the axial direction, when a tension is not applied to the drum head 3. As a result, when the drum head 3 is placed on one side of the shell 2 in the axial direction, the connection part between the flat part 32*a* and the cylindrical part 32*b* abuts against the end edge part 2*a*, on one side of the shell 2 in the axial direction. Moreover, the cylindrical part 32*b* is formed in a tapered shape having a smaller inside diameter on one end side relative to the inside diameter on the other side of the tapered shape.

When a tension is applied to the drum head 3, the flat part 32*a* is configured such that the connection part between the flat part 32*a* and the cylindrical part 32*b* abuts against the edge part 2*a* of the shell 2, on one side of the shell in the axial direction. Alternatively, the pair of outer head layers 32 may be configured only with the flat part 32*a*, with the cylindrical part 32*b* omitted. In that alternative configuration, the frame part 31 is affixed to the outer peripheral edge of the flat part 32*a*.

The inner head layer 33 can improve the feel (from the performer's perspective) of the flat part 32*a* when the performer strikes the flat part 32*a*. In particular embodiments, the inner head layer 33 is composed of a net-like breathable material. In further embodiments, the inner head layer 33 is composed of the same material as that of the pair of outer head layers 32.

Moreover, the inner head layer 33 is formed in a generally circular shape as viewed in a top-down view (viewed in the axial direction of the shell 2). The outside diameter D5 of the inner head layer 33 is smaller than the outside diameter D3 of the flat part 32*a* of the outer head layers 32 and the inside diameter D4 of the shell 2.

The drum head 3 is configured such that the outer peripheral edge of the pair of outer head layers 32 is affixed to the frame section 31, without bonding the inner head layer 33 to the pair of outer head layers 32. For example, in such embodiments, the inner head layer 33 may be simply placed between the pair of outer head layers 32.

As a result, restriction of relative displacements of the inner head layer 33 with respect to the pair of outer head layers 32 can be avoided. Moreover, the work required to connect the inner head layer 33 to the pair of outer head layers 32 can be omitted, which reduces the number of steps used to fabricate the drum head 3.

Referring back to FIG. 1, the hoop 4 is a ring-shaped member for applying a tension to the pair of outer head layers 32, by pressing down on the frame 31 of the drum head 3. The inside diameter of the hoop 4 is larger than the outside diameter D2 of the shell 2. Through holes 4*a* are formed at equal intervals along the circumferential direction of the hoop 4. Tension bolts 5 are inserted in the through holes 4*a* and retained at an upper surface side of the hoop 4 (an upper side in FIG. 1(*b*)).

A male screw thread is formed on the tension bolt 5, and a female screw thread engageable with the male screw thread of the tension bolt 5 is formed on the lug 6. By screwing the tension bolts 5 into the lug 6 while the tension bolts 5 are retained at the hoop 4, the hoop 4 and the frame part 31 of the drum head 3 are pushed down toward the other end of the shell 2 in the axial direction (a lower side of FIG. 1(*a*)). As a result, the pair of outer head layers 32 of the drum head 3 is pulled outwardly in the radial direction, and the drum head 3 is stretched over one end of the shell 2 to apply tension to the pair of outer head layers 32.

The outside diameter D5 of the inner head layer 33 is smaller than the outside diameter D3 of the flat part 32*a* of the outer head layers 32 and the inside diameter D4 of the edge part 2*a* of the shell 2 (see FIG. 2). As a result, the inner head layer 33 can be disposed inside the diameter of the connection part between the flat part 32*a* and the cylindrical part 32*b* of the pair of outer head layers 32 and inside the diameter of the edge part 2*a* of the shell 2. Therefore, when the drum head 3 is stretched and installed on the shell 2, the inner head layer 33 can be arranged to avoid being tensioned over the shell 2. Therefore, when a tension is applied to the pair of outer head layers 32, the tension can be prevented from being applied to the inner head layer 33.

In other words, compared to the case where a tension is applied to both of the pair of outer head layers 32 and the inner head layer 33, rebounding of the pair of outer head layers 32 and the inner head layer 33 when the head 3 is struck can be suppressed.

As a result, after the flat part 32*a* is struck by a stick or the like and the flat part 32*a* is pushed in the striking direction (downward direction in FIG. 1(*a*)), the amount of rebounding of the flat part 32*a* in a direction (upward direction in FIG. 1(*a*)) opposite to the striking direction can be reduced. In addition, the rebounding speed of the flat part 32*a* can be reduced. Therefore, compared to a case where tension is applied to both the pair of outer head layers 32 and the inner head layer 33, the response to striking the flat part 32*a* can be felt stronger.

Many acoustic drums use heads made of a film. In contrast, because the pair of outer head layers 32 is composed of a net-like material, the breathability of the head 3 is greater than that of the head made of a film. Therefore, in particular embodiments, the head 3 is configured to allow the passage of air through the pair of outer head layers 32 and the inner head layer 33, to reduce acoustic striking sound when the head 3 is struck.

However, because the pair of outer head layers 32 is composed of a net-like material, it has a smaller density at the striking surface and a lighter weight per unit area compared to a typical head made of a film. Also, the elasticity of the pair of outer head layers 32 can be higher than that of a head made of a film. Therefore, if a head composed of the pair of outer head layers 32 alone is struck, the amount of rebounding of the flat part 32*a* can be greater, and the rebounding speed of the flat part 32*a* can be faster, compared to a case in which a head made of a film is struck. Accordingly, the response to striking the head can feel weak to the performer. In contrast, by including the inner head layer 33 between the pair of outer head layers 32, the density of the striking surface can be increased and the weight per unit area can be increased. As a result, while the outer head layers 33 are made of a breathable material, the striking surface, when struck, can approximate the feel of striking a film used for an acoustic drum.

Moreover, if tension is applied to both of the pair of outer head layers 32 and the inner head layer 33, the inner head layer 33 will extend in a manner similar to the pair of outer head layers 32. As a result, in response to a strike on the head, both of the pair of outer head layers 32 and the inner head layer 33 rebound in a direction opposite to the striking direction. Therefore, compared with a case in which a head made of a film is struck, the response to striking the flat part 32*a* can feel weak to the performer.

In contrast, according to embodiments of the drum head 3, tension is not applied to the inner head layer 33 included between the pair of outer head layers 32, such that the response to striking the flat part 32*a* can feel strong to the performer. Therefore, embodiments described herein can not only reduce acoustic striking sound, but also provide a striking feeling similar to the feeling of striking the head of an acoustic drum.

The outside diameter of the inner head layer 33 may be arranged, as viewed in an axial direction of the frame part 31 (in the vertical direction in FIG. 1), within the entire area enclosed by a virtual circle that is concentric with the frame part 31. In particular embodiments, the outside diameter of the inner head layer 33 is at least ¼ of the inside diameter of the frame part 31 or greater. In further embodiments the outside diameter of the inner head layer 33 is ½ of the inside diameter of the frame part 31 or greater, or in yet further embodiments, ¾ of the inside diameter of the frame part 31 or greater.

As a result, the inner head layer 33 can be arranged in the central area of the drum head 3, where the drum head is more readily struck by the performer. Moreover, a greater radius of the virtual circle described above, results in a larger area in which the inner head layer 33 is present, with respect to the entire striking surface. As a result, the portion where the inner head layer 33 is present can be more readily struck.

In particular embodiments of the drum head 3, the pair of outer head layers 32 and the inner head layer 33 are composed of the same material. As a result, the inner head layer 33 can be deformed by the extension of the pair of outer head layers 32 when struck. Therefore, when the flat part 32*a* is struck, generation of a colliding sound by the outer head layers 32 colliding against the inner head layer 33 can be suppressed. Therefore, the acoustic striking sound can be further reduced, compared to a case where the inner head layer 33 and the outer head layers 32 are composed of mutually different materials. According to embodiments of the drum head 3, the inner head layer 33 is not bonded with the pair of outer head layers 32. As a result, vibrations of the pair of outer head layers 32 and vibrations of the inner head layer 33, upon striking, cancel each other out, such that the vibration of the outer head layers 32 and the inner head layer 33 can settle quicker. In addition, high-frequency components generated by vibrations of the outer head layers 32 and the inner head layer 33 can be reduced.

Further embodiments are described with reference to FIG. 3(*a*) and FIG. 3(*b*). According to embodiments described above, relative displacements within the frame 31 of the inner head layer 33 with respect to the pair of outer head layers 32 are not restricted. In contrast, in the embodiments of FIG. 3(*a*) and FIG. 3(*b*), relative displacements in the radial direction of the inner head layer 33 with respect to the pair of outer head layers 32 are restricted. The same reference numerals used in the embodiment discussed above are also used for corresponding features in FIGS. 3(*a*) and 3(*b*), and reference is made to the above description of those features.

Figure 3:
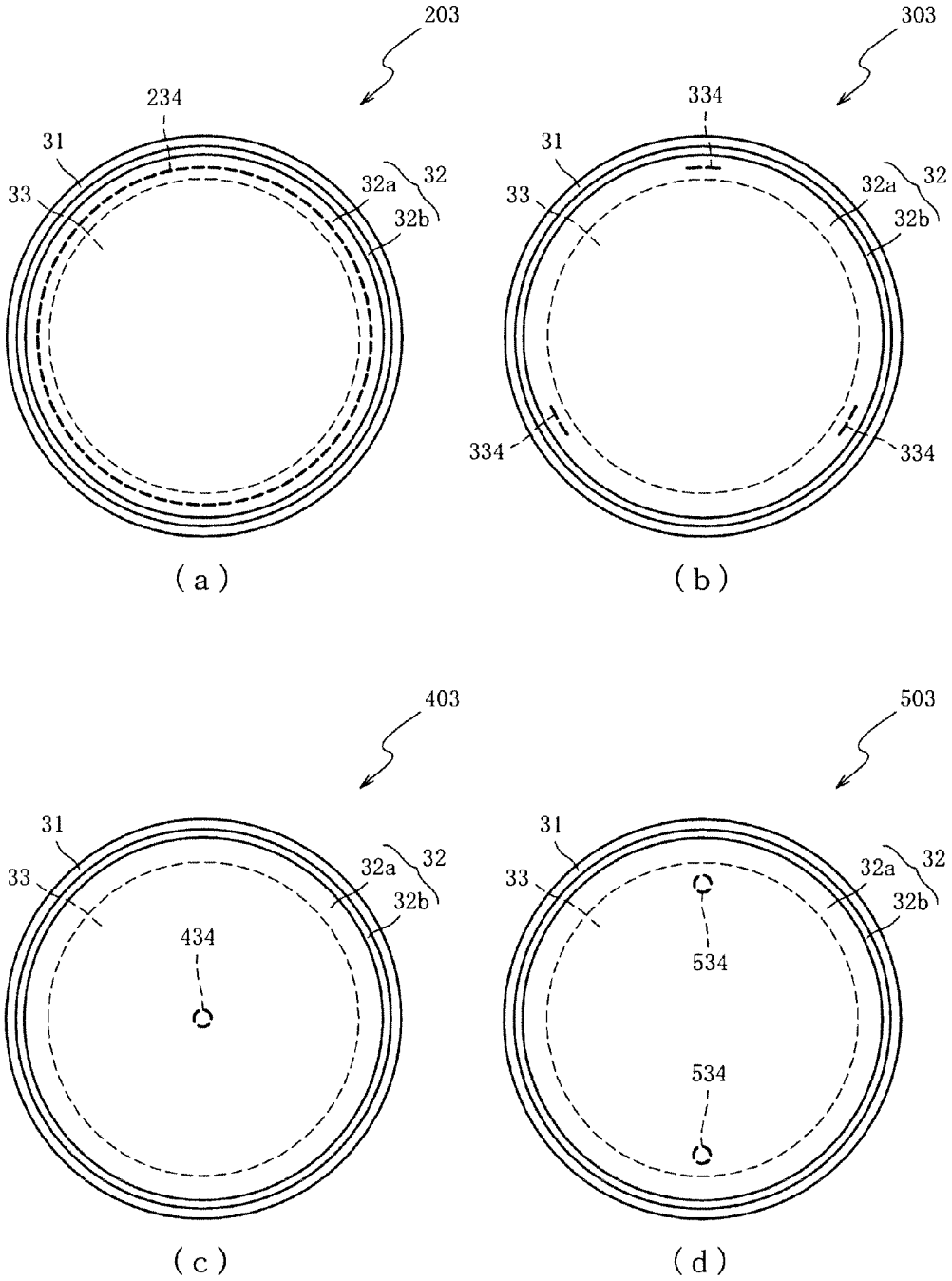
FIG. 3(*a*) is a top plan view of a drum head in accordance with a second embodiment of the present invention.

FIG. 3(*a*) is a top-down view of a drum head 203 in accordance with an embodiment of the present invention. Further, FIG. 3(*b*) is a top-down view of a drum head 303 in accordance with another embodiment of the present invention. In FIG. 3(*a*) and FIG. 3(*b*), the inner head layer 33 is shown by broken lines.

As shown in FIG. 3(*a*) and FIG. 3(*b*), drum heads 203 and 303 have connection parts 234 and 334, respectively, where the pair of outer head layers 32 are connected together. The connection parts 234 and 334 restrict relative displacements of the inner head layer 33 with respect to the pair of outer head layers 32, in the radial direction of the frame part 31. The connection parts 234 and 334 are shown in FIG. 3(*a*) and FIG. 3(*b*), schematically. Any suitable manner of bonding the pair of outer head layers 32*a* and 32*b* together may be employed including, but not limited to, sewing, bonding with an adhesive, welding, etc.

The connection parts 234 and 334, as viewed in the axial direction of the frame section 31 (vertical direction to the plane of the paper in FIG. 3(*a*) and FIG. 3(*b*)), are provided outside the outer peripheral edge of the inner head layer 33, and inside the connection part between the flat part 32*a* and the cylindrical part 32*b*. In the drum head 203 in accordance with the embodiment of FIG. 3(*a*), the connection part 234 is formed in a circular shape around the outer peripheral edge of the inner head layer 33. In the drum head 303 in accordance with the embodiment of FIG. 3(*b*), a plurality (three in FIG. 3(*b*)) of connection parts 334 are located at equal intervals in the circumferential direction around the outer peripheral edge of the inner head layer 33.

Accordingly, in the drum heads 203 and 303, as viewed in the axial direction of the frame part 31, relative radial displacements of the inner head layer 33 with respect to the pair of outer head layers 32 can be restricted. Accordingly, the inner head layer 33 will be placed within the inside of the inner circumference of the shell 2 by the action of stretching the outer head layers 32 over the shell 2, such that it would not be necessary to perform additional steps to confirm the placement of the inner head layer 33 inside the inner circumference of the shell 2 (see FIG. 1(*a*)). Therefore, the ability to stretch the drum head 203 and 303 over the shell 2 can be simplified.

In the drum head 203 in accordance with the embodiment of FIG. 3(*a*), the connection part 234 is formed in a circular shape around the outer peripheral edge of the inner head layer 33. As a result, relative displacements of the inner head layer 33 with respect to the pair of outer head layers 32 in the radial direction of the frame part 31 can be prevented.

Also, in the drum head 303 in accordance with the embodiment of FIG. 3(*b*), the connection parts 334 are arranged at three locations, at equal intervals in the circumferential direction. Accordingly, relative displacements of the inner head layer 33 with respect to the pair of outer head layers 32 in the radial direction of the frame part 31 can be prevented, and the procedure for bonding the pair of outer head layers 32 can be simplified relative to the embodiment of FIG. 3(*a*).

In the drum head 303, the pair of outer head layers 32 are connected at three locations, at equal intervals in the circumferential direction. However, in further embodiments, the pair of outer head layers 32 may be bonded at four locations or more. By reducing the connection parts in the pair of outer head layers 32, the procedure to connect the pair of outer head layers 32 together can be simplified, and the process of fabricating the drum head 303 can be simplified. On the other hand, by increasing the connection parts in the pair of outer head layers 32, relative displacements of the inner head layer 33 with respect to the pair of outer head layers 32 can be more surely prevented in the radial direction of the frame part 31.

Drum heads according to yet further embodiments of the present invention are described with reference to FIG. 3(*c*) and FIG. 3(*d*). In various embodiments described above, the inner head layer 33 is not bonded to the pair of outer head layers 32. In contrast, in the embodiments of FIG. 3(*c*) and FIG. 3(*d*), the inner head layer 33 is partially bonded to at least one of the pair of outer head layers 32. The same reference numerals used in the embodiments discussed above are also used for corresponding features in FIGS. 3(*c*) and 3(*d*), and reference is made to the above description of those features. FIG. 3(*c*) is a top-down view of a drum head 403 in accordance with an embodiment of the present invention. Further, FIG. 3(*d*) is a top-down view of a drum head 503 in accordance with a further embodiment of the present invention.

As shown in FIG. 3(*c*) and FIG. 3(*d*), the drum heads 403 and 503 have connection parts 434 and 534, respectively, where at least one of the outer head layers 32 is connected to the inner head layer 33. The connection parts 434 and 534 restrict relative displacements of the inner head layer 33 with respect to the pair of outer head layers 32 in the radial direction of the frame part 31. The connection parts 434 and 534 are shown in FIG. 3(*c*) and FIG. 3(*d*), schematically.

In particular embodiments, the inner head layer 33 is connected to the outer head layer 32 that is located on the upper side of the inner head layer 33 (front side of the plane of the paper in FIG. 3(*c*) and FIG. 3(*d*)). In further embodiments, the inner head layer 33 is connected to the outer head layer 32 that is located on the lower side of the inner head layer 33 (back side of the paper in FIG. 3(*c*) and FIG. 3(*d*)). In yet further embodiments, the inner head layer 33 is connected to both of the outer head layers 32.

In the drum head 403 of FIG. 3(*c*), the connection part 434 is provided at a single location in a center portion of the frame part 31. In the drum head 503 of FIG. 3(*d*), the connection parts 534 are formed inside of the peripheral edge part of the inner head layer 33, and are provided at two separated locations that are on opposite sides of the center axis of the frame part 31.

The breathability of the outer head layers 32 and the inner head layer 33 decreases where the inner head layer 33 is bonded to the pair of outer head layers 32. Therefore, if the entire upper or lower surface area of the inner head layer 33 were bonded to one of the outer head layers 32, the passage of air through the outer head layers 32 and the inner head layer 33 may not be sufficient to reduce acoustic sound. Therefore, a louder acoustic striking sound may be generated by striking the striking surface.

In contrast, by providing the connection parts 434 and 534 that connect part, but not an entire surface area of the inner head layer 33 to the outer head layers 32, greater breathability of the outer head layers 32 and the inner head layer 33 can be obtained. Accordingly, an acoustic striking sound that may be generated upon striking the striking surface can be reduced.

In particular embodiments, the ratio of the area of the connection part(s) 434 or 534 with respect to the upper or lower surface area of the entire inner head layer 33 is 20% or less. In further embodiments, the ratio of such areas is 10% or less, and in yet further embodiments, the ratio is 5% or less. As a result, the ability to stretch the drum head 203 and 303 over the shell 2 can be simplified, while acoustic striking sound is reduced, and relative displacements of the inner head layer 33 with respect to the pair of outer head layers 32 can be prevented.

Example embodiments of the invention have been described above. However, the invention need not be limited in any particular manner to the embodiments described above, and various improvements and changes can be made without departing from the subject matter of the invention.

For example, in each of the embodiments described above, one inner head layer 33 is placed between a pair of outer head layers 32. However, in further embodiments, a plurality of inner head layers 33 are arranged between a pair of outer head layers 32. By properly adjusting the number of inner head layer 33, the striking feeling similar to that of an acoustic drum can be obtained, when the drum head 3, 203, 303, 403 or 503 is struck.

In embodiments described above, the pair of outer head layers 32 and the inner head layer 33 are composed of the same material. However, in further embodiments, the inner head layer 33 is composed of a material different from that of the pair of outer head layers 32. Also in yet further examples of any of the above embodiments, the two outer head layers 32(*a*) and 32(*b*) is composed of mutually different materials.

In that case, at least the pair of outer head layers 32 is composed of a material having breathability. Also, the inner head layer 33 may also be composed of a material having breathability, such as a net-like material, a cloth-like material. As a result, the acoustic striking sound at striking can be reduced.

In embodiments described above, the inner head layer 33 is formed in a generally circular form. However, in further embodiments, the inner head layer 33 may be formed in another shape, for example, a polygonal shape, and/or a ring-shape.

In embodiments described above the drum head 3, 203, 303, 403, 503 may be for practice. In further embodiments, the drum head 3, 203, 303, 403, 503 may be configured as a head of an electronic drum.

The invention claimed is:

1. A drum head having a striking surface configured to be tensioned over a drum shell having an inner circumference, the drum head comprising:

a ring-shaped frame part having a diametric dimension defining an inner diameter;

a pair of outer head layers, each outer head layer having an outer peripheral edge affixed to the frame part and being composed of a material having breathability; and an inner head layer located between the pair of outer head layers and composed of a material having breathability, the inner head layer having an outer diameter that is smaller than an inner diameter of the ring-shaped frame part;

wherein the drum head and each of the inner head layer and the pair of outer head layers are configured to be breathable, when tensioned over a drum shell; wherein the inner head layer extends across the entire diametric dimension of the ring-shaped frame part, except in a gap between an outer peripheral edge of the inner head layer and the inner diameter of the ring-shaped frame part, as viewed in an axial direction of the ring-shaped frame part.

2. The drum head according to claim 1, wherein the pair of outer head layers has a flat part with a planar surface that forms the striking surface;

the pair of outer head layers further has a cylindrical part having one end connected at a connection part to an outer peripheral edge of the flat part and another end affixed to the frame part; and the inner head layer is located inside a diameter of the connection part that connects the flat part and the cylindrical part.

3. The drum head according to claim 1, wherein an outer diameter of the inner head layer is located, as viewed in an axial direction of the frame part, entirely within an area enclosed by a virtual circle that is concentric with the frame part and is one half of an inside diameter of the frame part.

4. The drum head according to claim 1, wherein the inner head layer is bonded to at least one of the outer head layers, the inner head layer extends across and defines an inner head layer area, and the ratio of an area where the inner head layer is bonded to at least one of the outer head layers to the entire inner head layer area is 10% or less.

5. The drum head according to claim 1, wherein the pair of outer head layers are bonded together in a location between an outer peripheral edge of the inner head layer and an inner circumference of the shell, as viewed in an axial direction of the frame part.

6. The drum head according to claim 1, wherein the pair of outer head layers and the inner head layer are composed of the same material.

7. A drum comprising:

a shell formed in a cylindrical shape; and a drum head having a striking surface tensioned over the shell, the drum head comprising:

a ring-shaped frame part having a diametric dimension defining an inner diameter;

a pair of outer head layers, each outer head layer having an outer peripheral edge affixed to the frame part and being composed of a material having breathability; and an inner head layer located between the pair of outer head layers and composed of a material having breathability, the inner head layer having an outer diameter that is smaller than an inside diameter of the ring-shaped frame part;

wherein the drum head and each of the inner head layer and the pair of outer head layers tensioned over the shell are breathable; wherein the inner head layer extends across the entire diametric dimension of the ring-shaped frame part, except in a gap between an outer peripheral edge of the inner head layer and the inner diameter of the ring-shaped frame part, as viewed in an axial direction of the ring-shaped frame part.

8. The drum according to claim 7, wherein the pair of outer head layers has a flat part with a planar surface that forms the striking surface;

the pair of outer head layers further has a cylindrical part having one end connected at a connection part to an outer peripheral edge of the flat part and another end affixed to the frame part; and the inner head layer is located inside a diameter of the connection part that connects the flat part and the cylindrical part.

9. The drum according to claim 7, wherein an outer diameter of the inner head layer is located, as viewed in an axial direction of the frame part, entirely within an area enclosed by a virtual circle that is concentric with the frame part and is one half of an inside diameter of the frame part.

10. The drum according to claim 7, wherein the inner head layer is bonded to at least one of the outer head layers, the inner head layer extends across and defines an inner head layer area, and the ratio of an area where the inner head layer is bonded to at least one of the outer head layers to the entire inner head layer area is 10% or less.

11. The drum according to claim 7, wherein the pair of outer head layers are bonded together in a location between an outer peripheral edge of the inner head layer and an inner circumference of the shell, as viewed in an axial direction of the frame part.

12. The drum head according to claim 7, wherein the pair of outer head layers and the inner head layer are composed of the same material.

13. A method of making a drum head having a striking surface configured to be tensioned over a drum shell having an inner circumference, the method comprising:

providing a ring-shaped frame part having a diametric dimension defining an inner diameter;

affixing an outer peripheral edge of a pair of outer head layers to the frame part, each of the outer head layers being composed of a material having breathability; and locating an inner head layer between the pair of outer head layers, the inner head layer composed of a material having breathability, and the inner head layer having an outer diameter that is smaller than an inside diameter of the ring-shaped frame part;

wherein the drum head and each of the inner head layer and the pair of outer head layers are configured to be breathable, when tensioned over a drum shell; wherein the inner head layer extends across the entire diametric dimension of the ring-shaped frame part, except in a gap between an outer peripheral edge of the inner head layer and the inner diameter of the ring-shaped frame part, as viewed in an axial direction of the ring-shaped frame part.

14. The method according to claim 13, further comprising:

providing the pair of outer head layers with a flat part having a planar surface that forms the striking surface;

providing the pair of outer head layers with a cylindrical part having one end connected at a connection part to an outer peripheral edge of the flat part and another end affixed to the frame part; and locating the inner head layer inside a diameter of the connection part that connects the flat part and the cylindrical part.

15. The method according to claim 13, wherein an outer diameter of the inner head layer is located, as viewed in an axial direction of the frame part, entirely within an area enclosed by a virtual circle that is concentric with the frame part and is one half of an inside diameter of the frame part.

16. The method according to claim 13, further comprising bonding the inner head layer to at least one of the outer head layers, wherein the inner head layer extends across and defines an inner head layer area, and the ratio of an area where the inner head layer is bonded to at least one of the outer head layers to the entire inner head layer area is 10% or less.

17. The method according to claim 13, further comprising bonding the outer head layers together in a location between an outer peripheral edge of the inner head layer and an inner circumference of the shell, as viewed in an axial direction of the frame part.

18. The drum head according to claim 1, wherein the diametric dimension of the ring-shaped frame part extends through two farthest and opposite points on the ring-shaped frame part and through a center axis of the ring-shaped frame part.

19. The drum head according to claim 1, wherein the diametric dimension of the ring-shaped frame part crosses a radial center of the ring-shaped frame part.

20. The drum head according to claim 1, wherein the inner head layer has an outer peripheral edge that is spaced from the ring-shaped frame part along the entire inner diameter of the ring-shaped frame part.

21. The drum head according to claim 1, wherein each of the outer head layers extends across the diametric dimension of the ring-shaped frame part, as viewed in an axial direction of the ring-shaped frame part.

* * * * *